US005566483A

United States Patent [19]

Ogren

[11] Patent Number: 5,566,483

[45] Date of Patent: Oct. 22, 1996

[54] ILLUMINATED SIGN

[76] Inventor: Andrew R. Ogren, 9752 Wedgewood Alcove, Woodbury, Minn. 55125

[21] Appl. No.: 295,159

[22] Filed: Aug. 24, 1994

Related U.S. Application Data

[63] Continuation of Ser. No. 981,194, Nov. 25, 1992, abandoned.

[51] Int. Cl.[6] ..... G09F 13/04

[52] U.S. Cl. ..... 40/564; 40/606; 362/806

[58] Field of Search ..... 40/540, 541, 564, 40/606, 603, 604, 800; 362/240, 449, 806, 812; 428/16, 17; 206/457; 248/156

[56] References Cited

U.S. PATENT DOCUMENTS

| | | | |
|---|---|---|---|
| 2,401,241 | 5/1946 | Grobholz | 40/152.1 |
| 3,093,918 | 6/1963 | Krakauer et al. | 40/540 |
| 3,220,130 | 11/1965 | Falkenberg . | |
| 3,225,476 | 12/1965 | Bockmann | 40/603 X |
| 3,365,827 | 1/1968 | Leif | 40/152.1 |
| 3,550,299 | 12/1970 | Salz | 40/642 X |
| 3,813,064 | 5/1974 | Heyworth . | |
| 4,077,146 | 3/1978 | Nasgowitz | 40/540 X |
| 4,139,957 | 2/1979 | Minogue . | |
| 4,831,760 | 5/1989 | Walker . | |
| 4,894,937 | 1/1990 | Davis | 40/606 |
| 4,901,461 | 2/1990 | Edwards et al. . | |
| 4,928,415 | 5/1990 | Walters | 40/610 |
| 5,020,254 | 6/1991 | Sheppard . | |
| 5,042,183 | 8/1991 | Kennedy | 248/156 X |
| 5,099,592 | 3/1992 | Layne . | |
| 5,134,550 | 7/1992 | Young . | |

*Primary Examiner*—Brian K. Green
*Attorney, Agent, or Firm*—Kinney & Lange, P.A.

[57] ABSTRACT

An illuminable decorative sign having a backing member, and a display member which is mismatched in size thereto, which are fastened together to form an accessible, covered illumination space.

19 Claims, 4 Drawing Sheets

HAPPY
HALLOWEEN
10
11
12
13
14
15
21
22

10
11
12
15
16
17
18
19
20
21
22
23
3

11
12
14
15
18
19
20
21
22

10
11
12'
15
15'
16
17
18
19
20
21
24

ILLUMINATED SIGN

This is a continuation-in-part of application Ser. No. 07/981,194, filed Nov. 25, 1992, now abandoned. Priority of the prior application is claimed pursuant to 35 USC § 120.

BACKGROUND OF THE INVENTION

The present invention relates to illuminated signs and, more particularly, to illuminated signs which are relatively portable for temporary positioning.

Illuminated decorative signs have been used extensively in various forms in the past, but often tend to be of relatively high cost. Although this may not be an insurmountable problem for several kinds of commerce, such signs for home use, say, in connection with festive occasions, for instance, or for use in other kinds of commerce, must be fairly inexpensive if they are to be successful in such uses.

Nevertheless, signs for such cost sensitive uses must be sufficiently interesting in terms of the indicia which can be provided thereon to accomplish the intended purpose therefor, and they must be sufficiently large for potential viewers to see at the desired distances. Such needs run counter to minimizing cost in many instances.

In addition, particularly for home use on festive occasions, the ability to display the sign with relatively little effort, and to thereafter remove and store the sign with relatively little effort, is important. Thus, there is desired an illuminated sign construction which is convenient, easily ported, and inexpensive.

SUMMARY OF THE INVENTION

The present invention provides an illuminable decorative sign suited for at least temporary positioning adjacent a surface having a backing member onto which is fastened a display member in a manner such that it bows out to provide a covered illumination space. A mount in the backing member permits installing the sign at the surface, the mount being either a mounting tab in the backing member or a mounting standard inserted in the backing member. Access to the illumination Space can be provided by moveable access tabs in the backing member, and which can also serve as supports for lights used in the sign.

DETAILED DESCRIPTION OF THE PREFERRED EMBODIMENTS

Figure 1:
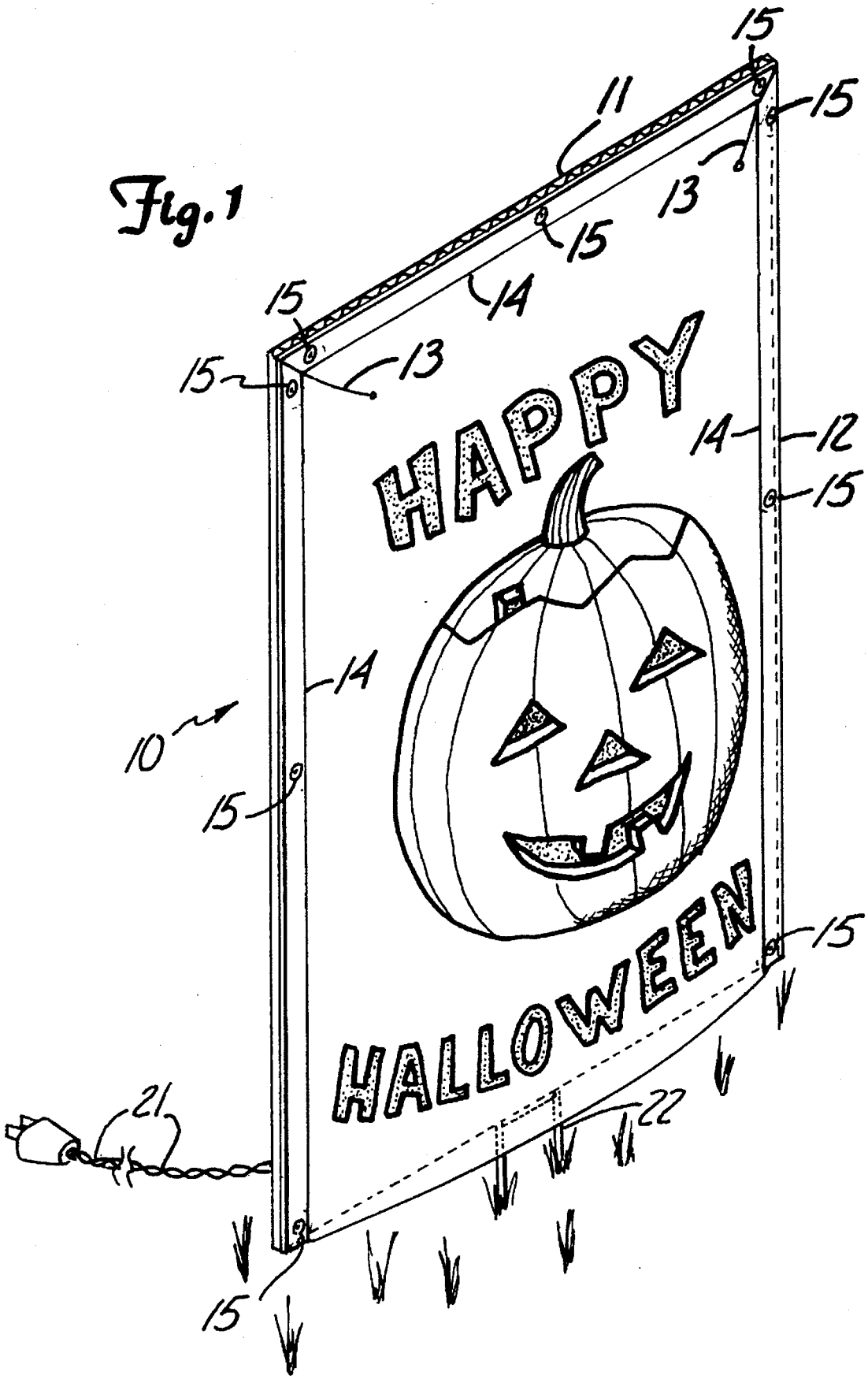
FIG. 1 is a front pictorial view of a sign embodying the present invention.
Figure 2:
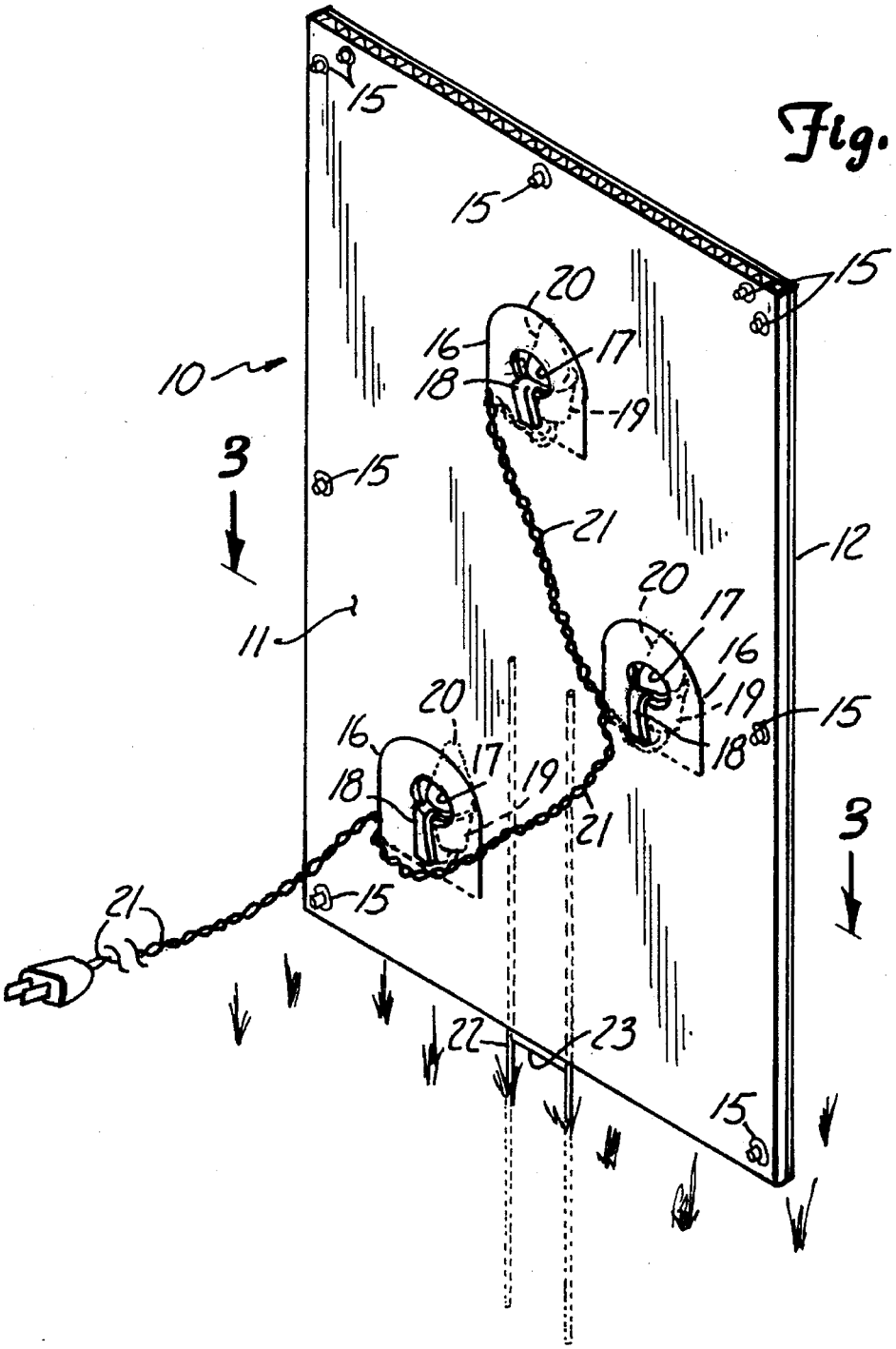
FIG. 2 is a pictorial rear view of the sign of FIG. 1.

FIG. 1 shows a sign, 10, in a front pictorial view. A rear pictorial view of this same sign is shown in FIG. 2, and a cross section view of FIG. 2 appears in FIG. 3.

In these figures, there is shown a backing member, 11, formed of a polymer corrugated board, i.e. a board formed like cardboard but with the use of high density polypropylene therein rather than paper. The corrugated interior sheet adhered to two flat sheets, one on either side thereof to form board 11, is there to strengthen and stiffen the resulting board. Both the interior corrugated sheet and the sheets on either side thereof are formed with high density polypropylene with at least the one sheet face directed toward the interior space of the sign (described below) being suitably reflective of visible light. As shown in FIGS. 1 and 2, the corrugations are such that the open channels on alternating sides of the corrugated interior sheet extend more or less vertically in those figures for a sign extending vertically above the ground in which it, as an example, is installed.

A flexible, translucent sheet, 12, also formed of polypropylene with a thickness typically of 0.040 inches, forms a sign display member. Translucent sheet 12 is one and one-half inches greater in horizontal dimension than is corrugated board 11. Also, sheet 12 is one and one-quarter inches greater in vertical dimension than is corrugated board 11. Sheet 12 is die cut so as to leave a pair of cuts, 13, extending diagonally inward from the upper two corners of sheet 2, as can be seen in FIG. 1.

As a result, if the two vertical edges and the top horizontal edge of translucent sheet 12 are aligned with the corresponding edges of corrugated board 11 and fastened thereto, sheet 12 will bow out and away, at least in its interior portions, from corrugated board 11. Translucent sheet 12 is scored linearly in parallel to these edges, and a bit inwardly of them, to permit rim portions between these edges and such scoring, 14, to lie flat against corrugated board 11. In that position, these rim portions of translucent sheet 12 are riveted to similar border portions of corrugated board 11 located adjacent to its corresponding outer edges by rivets, 15. These rivets may be either plastic or metal rivets.

Figure 3:
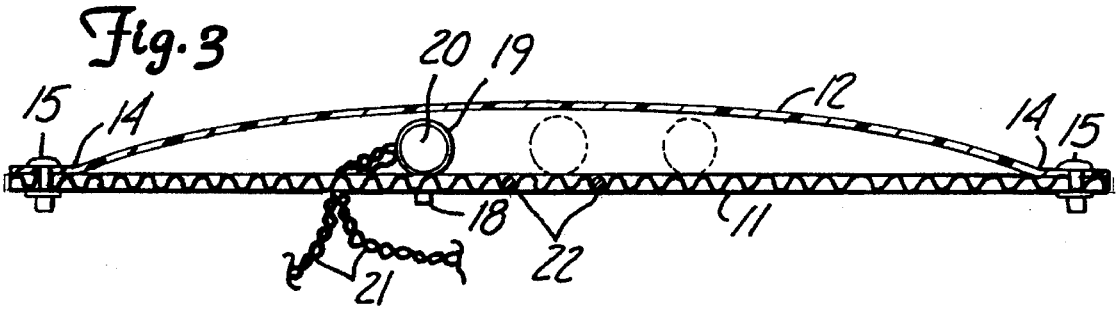
FIG. 3 is a cross section view taken from the sign of FIG. 2.

This resulting bowing out of translucent sheet 12 from corrugated board 11, at least at interior portions of sheet 12, creates an illumination space between these two members of the sign structure partly shown in cross section in FIG. 3, a space covered at its top for a vertically mounted sign as shown in FIGS. 1 and 2. Such a covering of this illumination space protects it to a substantial degree from precipitation, dirt, dropped objects, etc.

As can be seen in FIG. 2, three tabs, 16, have been formed in the interior of corrugated board 11 through two parallel, spaced apart cuts in that board having been made on for two vertical sides of each such tab which are joined by a rounded top cut. The bottom side of the tabs are not cut, and so remain attached to the other portions of corrugated board 11. Thus, each of these tabs may be swung out from the plane of corrugated board 11 as desired, and then swung back into that plane, while remaining attached to, and as part of, board 11.

Moving any of tabs 16 out of the plane of board 11 gives an access to the illumination space, and these tabs can also provide a mounting arrangement for mounting those lights to be used in the illuminated sign through being present in the illumination space. Thus, each of tabs 16 has a hole, 17, therein which can be used as a way of gripping a corresponding tab 16 to permit conveniently pulling it out of the plane of corrugated board 11. In addition, as can be seen in FIG. 2, clips, 18, from a corresponding number of light bulb holders, 19, are shown slipped over portions of corresponding ones of tabs 16 by first being inserted through that one of holes 17 present therein. Each of light bulb holders 19 has a light bulb, 20, provided therein which may be a common "C7" light to form a "weatherproof" lighting fixture. A power cord, 21, forms a light string to electrically interconnect light bulb holders 19 in common, and cord 21 extends past sign 10 for being conveniently reached in extending electrical power from a source thereof to that sign.

Thus, by simply grasping a tab 16 at its hole 17 and pulling back and downward, corresponding light bulb holder 19 and light bulb 20 is made immediately available to the person operating the sign should a bulb need to be replaced. Afterward, pushing tab 16 upward toward translucent sheet 12 until it reaches the plane of corrugated board 11 places light bulb holder 19 and light bulb 20 in the illumination space between corrugated board 11 and translucent sheet 12.

The lower two tabs 16 are shown in FIG. 2 to be positioned off center in corrugated board 11. This permits the insertion of a mounting stand, 22, formed of a pair of parallel rods, into two of the vertical channel openings in the interior of corrugated board 11. The two rods in mount 22 are joined by a cross member, 23, which holds them together and also provides support for the bottom of corrugated board 11. The diameter of the vertical rods in mounting stand 22 is just small enough to fit into two of the channel openings made by the corrugations between the two sides forming corrugated board 11 as can be seen in FIG. 3. Thus, sign 10 is easily positioned in a yard where desired by simply putting mounting stand 22 into the ground at that location and slipping sign 10 thereover so that the two rods in stand 22 extend into the corrugation channel openings in corrugated board 11.

As can be seen in FIG. 1, a selected indicia is shown printed onto the front of translucent sheet 12. As a result, a rugged but inexpensive illuminated sign is formed very inexpensively, and can be set up where desired in a yard, for instance, and later taken down with little effort for storage.

Figure 4:
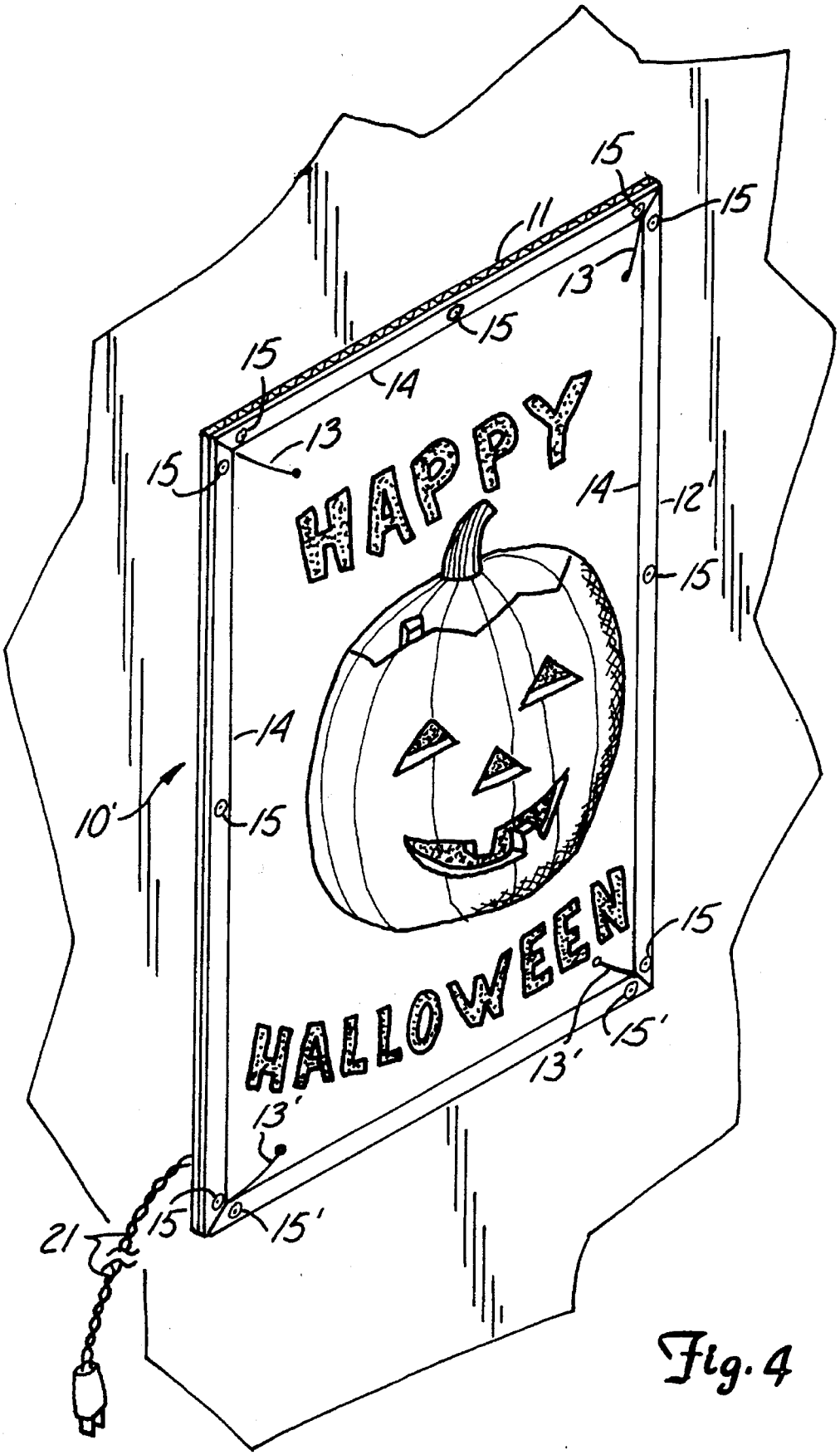
FIG. 4 is a front pictorial view of a sign alternatively embodying the present invention.

An alternative form for sign 10 is shown in front pictorial view in FIG. 4, a form which is more suited for hanging on a wall so that it is redesignated 10' in that figure. The dimensions and material of backing member 11 remain unchanged as shown but, of course, the dimensions can be selected for sign 10 as desired. However, the translucent sheet forming the front of the sign has been enlarged by one and one-quarter inches in the vertical direction and so has been redesignated 12' in FIG. 4. In addition, two further die cuts, 13', are shown made diagonally inward from the two lower corners of sheet 12'. As a result, the lower side of the illumination space, formed from the bowing out of sheet 12' from backing member 11 in the same manner as sheet 12 bows out therefrom, now has a finishing cover thereover formed by riveting the bottom of sheet 12' to the lower edge of backing member 11 by adding two further rivets, 15'. Sheet 12' is also further scored, this time parallel to its lower edge and a bit inward therefrom.

Figure 5:
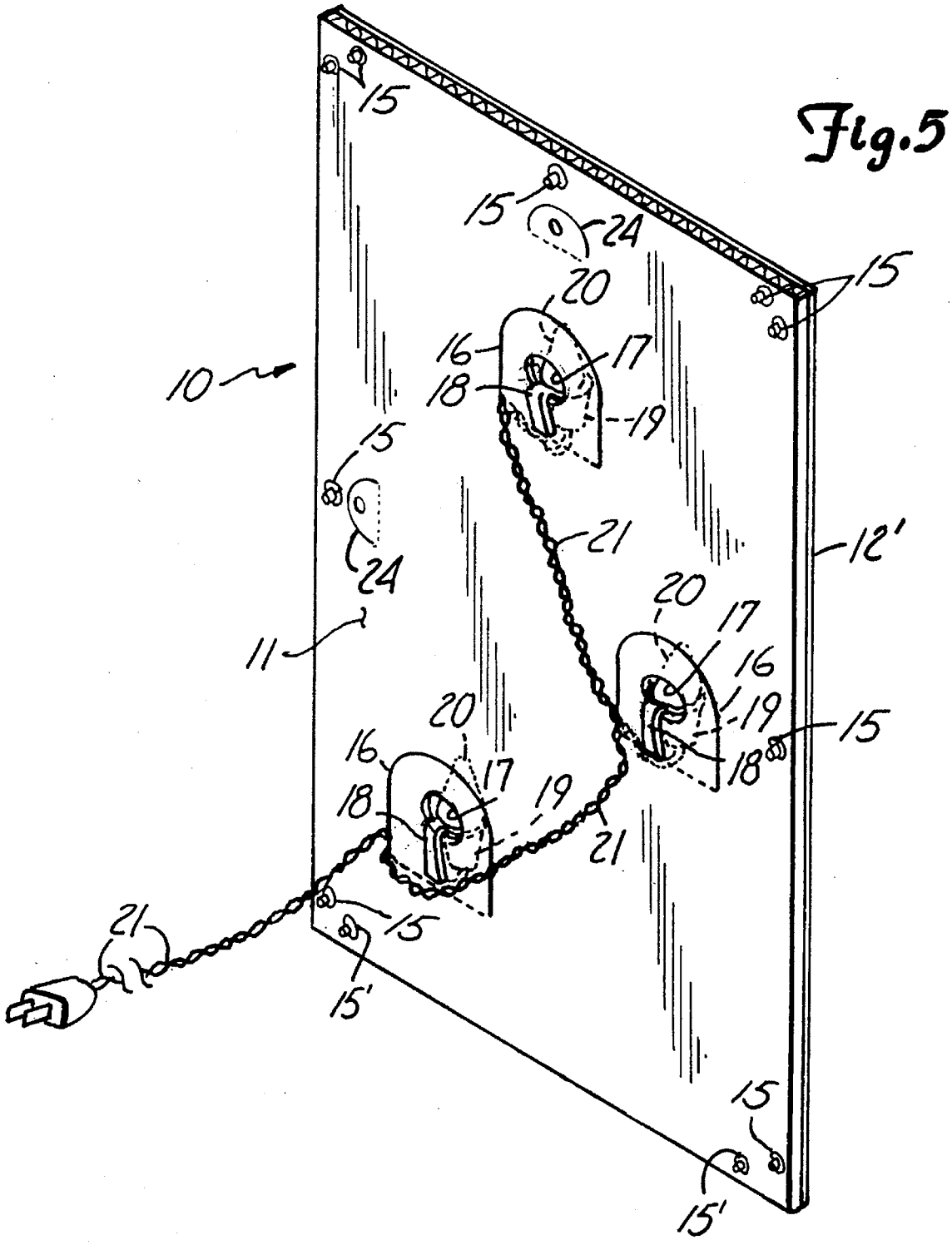
FIG. 5 is a pictorial rear view of the sign of FIG. 4.

A rear pictorial view of sign 10' is shown in FIG. 5. Rather than mounting stand 22 being in backing member 11 through having the parallel rods thereof extend into the channel openings in the corrugations therein, two additional hanging tabs, 24, have been cut in backing member 11 by having two spaced apart parallel cuts joined by a curved cut at the same ends thereof. No such cut joins the remaining two ends thereof so that tabs 24 remain attached to the other portions of corrugated board of backing member 11 where they may be swung out from, and into, the plane of that board. Each of tabs 24 have a hole therein from which sign 10' can be alternatively hung on a wall or other surface. Of course, other mounting means could alternatively be attached to tabs 24 or could be attached to backing member 11 in place of tabs 24. Thus, an illuminated and decorative wall sign can be positioned as desired on a wall assuming access to an electrical power outlet.

Although the present invention has been described with reference to preferred embodiments, workers skilled in the art will recognize that changes may be made in form and detail without departing from the spirit and scope of the invention.

What is claimed is:

1. An illuminable decorative sign suited for at least temporary positioning adjacent a surface, said sign comprising:

a backing member of a relatively stiff material;

a display member of a relatively flexible, translucent sheet of material having dimensions in a pair of opposite directions in said sheet, and in a third direction in said sheet, exceeding those of corresponding mounting locations in said backing member in corresponding directions in said backing member, said display member being fastened, at edges thereof crossing each of said pair of opposite directions and said third direction, to said corresponding mounting locations in said backing member such that interior portions of said display member bow out and away from said backing member because of said fastening of said display member to said mounting locations in said backing member to create an illumination space therebetween so that, if lights are mounted on said backing member, they can be enclosed in said illumination space, said display member and said backing member each being rectangular in outline with said translucent sheet of said display member having at least a pair of opposite sides thereof being separated by a greater dimension than corresponding sides of said backing member, said translucent sheet having a cut therein extending into its interior from each of two corners thereof, said display member being substantially linearly scored parallel to, and adjacent to, edges thereof fastened to said backing member, said display member having selected indicia provided thereon; and a mounting member provided at least in part in said backing member to permit installation of said sign at said surface.

2. The illuminable decorative sign of claim 1 wherein said backing member has a plurality of tab cuts therein defining elongated access tabs which can be bent away from, and back into, said backing member.

3. The illuminated decorative sign of claim 2 wherein each of said access tabs has a hole cut therein.

4. The illuminable decorative sign of claim 3 wherein a light bulb holder and a light bulb are mounted on a said access tab at least in part through said hole therein.

5. The illuminable decorative sign of claim 4 wherein a light formed by said light bulb holder and said light bulb are weatherproof.

6. The illuminable decorative sign of claim 1 wherein said relatively stiff material of said backing member is a corrugated board structure formed of high density polypropylene.

7. The illuminable decorative sign of claim 1 wherein said translucent sheet of said display member is formed of polypropylene.

8. The illuminable decorative sign of claim 1 wherein said display member is fastened to said backing member with rivets.

9. The illuminable decorative sign of claim 1 wherein said mounting member is elongated between a pair of ends thereof, said pair of ends having at least one member thereof suited for insertion into a mount receiving opening in said backing member.

10. The illuminable decorative sign of claim 9 wherein said mounting member is formed of substantially parallel rods having a cross member holding them together.

11. The illuminable decorative sign of claim 10 wherein said relatively stiff material of said backing member is formed from a corrugated sheet adhered to, and positioned between, two substantially flat sheets, and wherein said parallel rods fit into corresponding ones of those corrugations provided in said corrugated sheet.

12. The illuminable decorative sign of claim 1 wherein said mounting member is formed by a tab cut in said backing member defining at least one elongated hanging tab which can be bent away from, and back into, said backing member.

13. The illuminable decorative sign of claim 1 wherein a second pair of opposite sides of said translucent sheet are also separated by a greater dimension than corresponding sides of said backing member.

14. The illuminable decorative sign of claim 1 wherein said translucent sheet has cuts therein extending into its interior from each of two corners thereof.

15. The illuminable decorative sign of claim 1 wherein said display member is fastened to said backing member by rivets.

16. The illuminable decorative sign of claim 1 wherein said display member is fastened to said backing member by rivets and wherein said rivets are positioned in said display member between said scoring and said edges thereof fastened to said backing member.

17. An illuminable decorative sign suited for at least temporary positioning adjacent a surface, said sign comprising:

a backing member of a relatively stiff material;

a display member of a relatively flexible, translucent sheet of material having dimensions in a pair of opposite directions in said sheet, and in a third direction in said sheet, exceeding those of corresponding mounting locations in said backing member in corresponding directions in said backing member, said display member being fastened, at edges thereof crossing each of said pair of opposite directions and said third direction, to said corresponding mounting locations in said backing member such that interior portions of said display member bow out and away from said backing member because of said fastening of said display member to said mounting locations in said backing member to create an illumination space therebetween so that, if lights are mounted on said backing member, they can be enclosed in said illumination space, said display member having selected indicia provided thereon;

a mounting member provided at least in part in said backing member to permit installation of said sign at said surface; and a plurality of tab cuts in said backing member defining elongated access tabs which can be bent away from, and back into, said backing member, each of said access tabs having a hole cut therein which would permit a light source to be mounted on a said access tab at least in part through said hole therein.

18. The illuminable decorative sign of claim 17 wherein a said light source is mounted on a said access tab and comprises a light bulb holder and a light bulb.

19. The illuminable decorative sign of claim 18 wherein said light source formed by said light bulb holder and said light bulb is weatherproof.

* * * * *